United States Patent [19]

Johnson

[11] Patent Number: 4,903,614

[45] Date of Patent: Feb. 27, 1990

[54] MULTI-FUNCTIONAL TABLE

[76] Inventor: John S. Johnson, 1480 Kelley St., Oroville, Calif. 95965

[21] Appl. No.: 349,813

[22] Filed: May 10, 1989

[51] Int. Cl.[4] ..... A47B 3/00

[52] U.S. Cl. ..... 108/19; 108/12

[58] Field of Search ..... 108/12, 19, 144

[56] References Cited

U.S. PATENT DOCUMENTS

| | | | |
|---|---|---|---|
| 36,781 | 10/1862 | Hunter | 108/19 X |
| 732,585 | 6/1903 | Reinhardt | 108/19 |
| 1,039,868 | 10/1912 | Whitney | 108/12 |
| 2,398,693 | 4/1946 | Bureau | 108/19 |
| 2,678,858 | 5/1954 | Davis | 108/19 |
| 4,237,795 | 12/1980 | Parker | 108/19 X |
| 4,462,636 | 7/1984 | Markson | 108/19 X |

*Primary Examiner*—Peter A. Aschenbrenner
*Attorney, Agent, or Firm*—Norman B. Rainer

[57] ABSTRACT

A multi-functional table of adjustable height has concealed supplementary legs capable of being swung downwardly to effectively extend the lengths of the four main legs of the table. The supplementary legs are concealed within housings that extend between the lower extremities of adjacent main legs. A release mechanism, operable from above the housings, controls the release of the supplementary legs. The deployed supplementary legs are secured by an upward sliding motion.

5 Claims, 2 Drawing Sheets

MULTI-FUNCTIONAL TABLE

BACKGROUND OF THE INVENTION

This invention relates to a table useful as furniture, and more particularly concerns a table whose height is adjustable, thereby making it a versatile article of furniture.

The use of tables with folding legs is well known wherein the legs of the table fold against the flat upper panel of the table to create a readily storable compact structure.

Tables capable of adjustable elevation of the upper panel of the table relative to the floor which supports the legs of the table are disclosed in U.S. Pat. Nos. 732,585; 2,398,693 and 2,679,858. Such tables either compromise structural strength to achieve their versatility, or have an appearance which is unsuitable for indoor furniture use.

The conventional so-called "coffee table" is customarily built with short legs so that it stands but a short height above the floor, and has utility primarily in front of another piece of furniture, such as a sofa or the like. On the other hand, a television table or tray disposes the upper table surface at a height of about 24 inches such that persons seated upon chairs of conventional height can comfortably sit at the table.

It is accordingly an object of the present invention to provide a table of adjustable height, making it interchangably suitable for use either as a coffee table or television table.

It is another object of this invention to provide a table as in the foregoing object wherein the adjustability function is not evident in the external appearance of the table.

It is a further object of the present invention to provide a table of the aforesaid nature wherein the interconversion between the two modes of use is easily achieved.

It is yet another object of the invention to provide a table of the aforesaid nature that is sturdy in both modes of use, and is amenable to low cost manufacture.

These objects and other objects and advantages of the invention will be apparent from the following description.

SUMMARY OF THE INVENTION

The above and other beneficial objects and advantages are accomplished in accordance with the present invention by a table comprising:

(a) a flat top panel having upper and lower surfaces and adapted to be horizontally disposed, (b) four straight main legs extending vertically downwardly from said top panel in a rectangular locus, said main legs being in fixed engagement with said top panel, the distal lower extremities of said main legs being disposed in a horizontal plane, (c) paired straight hollow housings in opposed parallel relationship, each housing extending between the terminal extremities of two opposed contiguous main legs, said housings having open bottom portions, and end portions adjacent each main leg, (d) two straight supplementary legs stored within each housing, each supplementary leg having a proximal extremity pivotably secured to the housing adjacent the terminal extremity of a main leg, and a distal extremity adapted to swing downwardly into a deployed mode in vertical alignment with an associated main leg, (e) holding means located within the end portions of each housing for securing each supplementary leg in its deployed mode, and (f) retaining means associated with each housing for preventing inadvertent deployment of the supplementary legs.

Whether the table is in its lower form wherein the supplementary legs are stored, or in the high form wherein the supplementary legs are in their deployed mode, the paired housings impart strength and stability to the table. In its lower form, a cushion may be placed upon the top panel, thereby enabling the table to be used as a seat or a foot stool.

In a preferred embodiment, the supplementary legs are deployable by gravity force alone and are secured in place by the holding means merely by pressing the proximal extremity upward into the housing.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
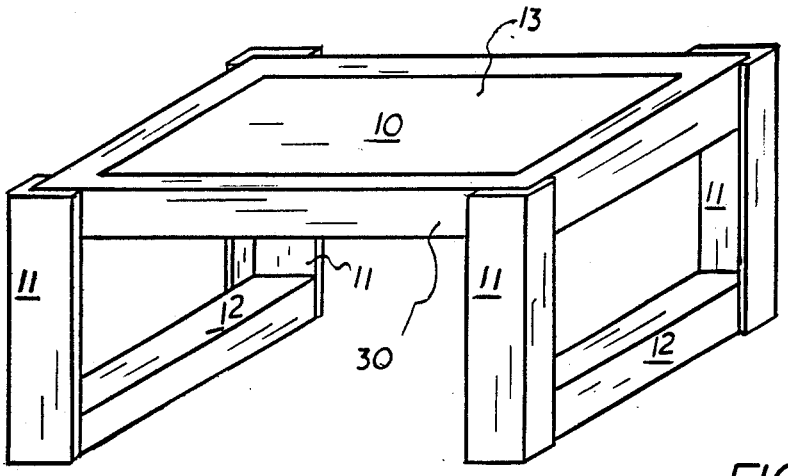
FIG. 1 is a perspective view of an embodiment of the table of the present invention in its low mode.
Figure 2:
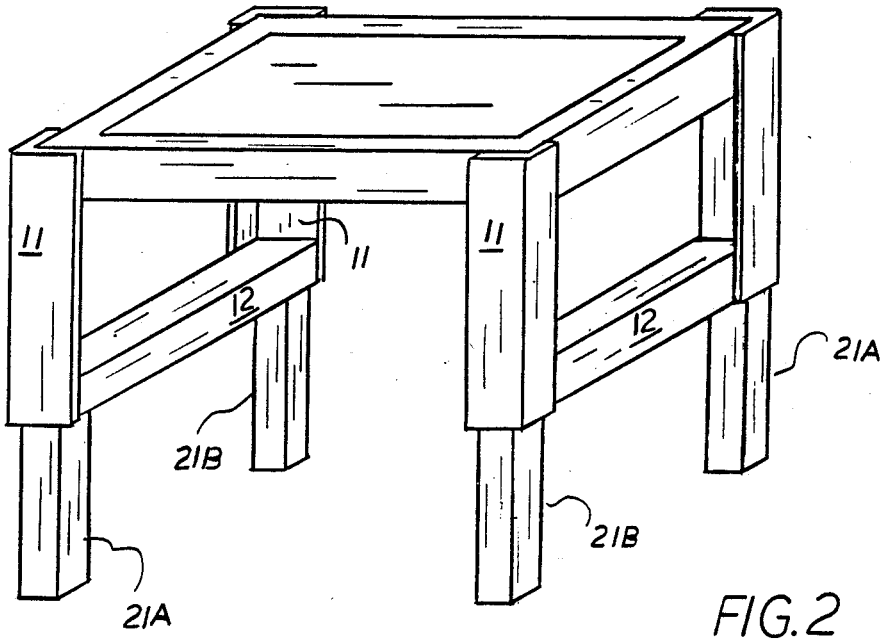
FIG. 2 is a perspective view of the table of FIG. 1 in its high mode.
Figure 3:
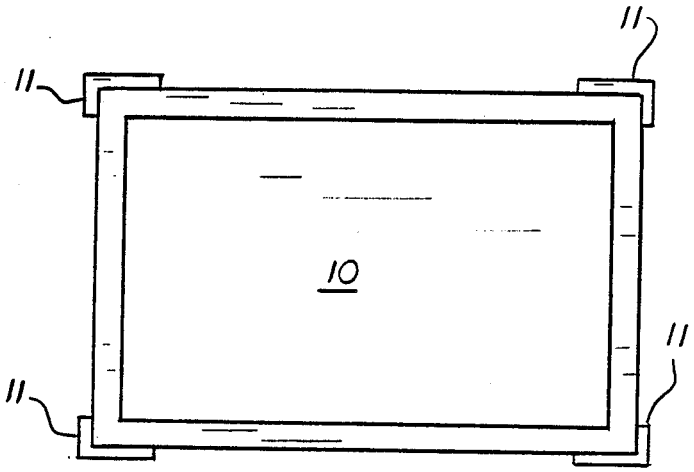
FIG. 3 is a top plan view thereof.
Figure 5:
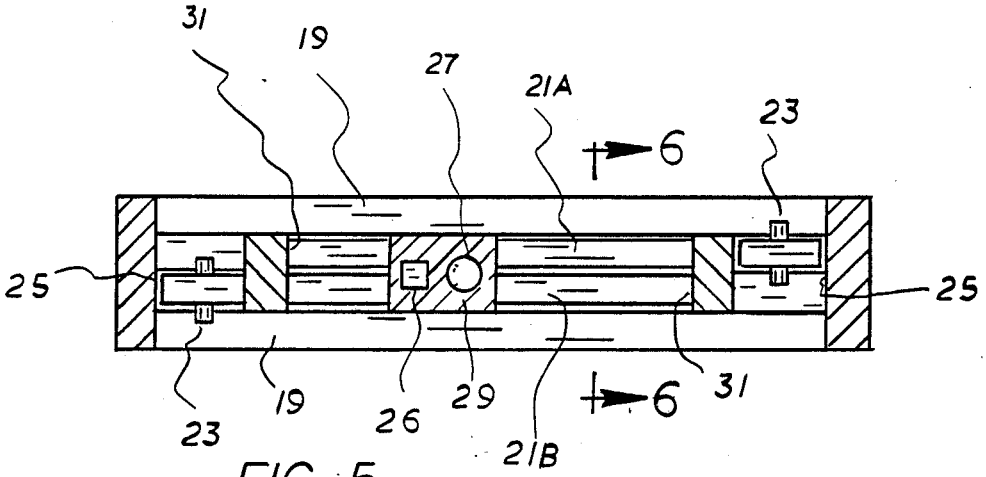
FIG. 5 is a sectional view taken upon the line 5—5 of FIG. 4 showing both supplementary legs in their stored mode.

Referring to FIGS. 1–6, an embodiment of the table of the present invention is shown comprised of flat top panel 10 supported by four main legs 11, and paired parallel housings 12 extending between legs 11.

Top panel 10 in the illustrated embodiment is shown to have a rectangular perimeter 13. In other embodiments, the perimeter could be of round, oval or other configuration. Panel 10 is further defined by flat upper surface 14 and lower surface 15. In the illustrated embodiment, a sidewall 30 surrounds panel 10, extending above upper surface 14. This defines an enclosure adapted to retain a seating cushion.

The four main legs 11 are fixedly attached at their uppermost extremities 16 to top panel 12, and extend vertically downwardly therefrom in a rectangular locus, to terminal extremities 17 which lie in the same horizontal plane.

The paired housings 12 are in opposed parallel relationship, each extending between and joining with the terminal extremities of two contiguously located main legs. Each housing is fabricated of roof panel 18 and opposed side panels 19 which in combination define a downwardly opening interior cavity 20. The lateral extremities of the housing adjacent the main legs may be considered end portions.

Figure 4:
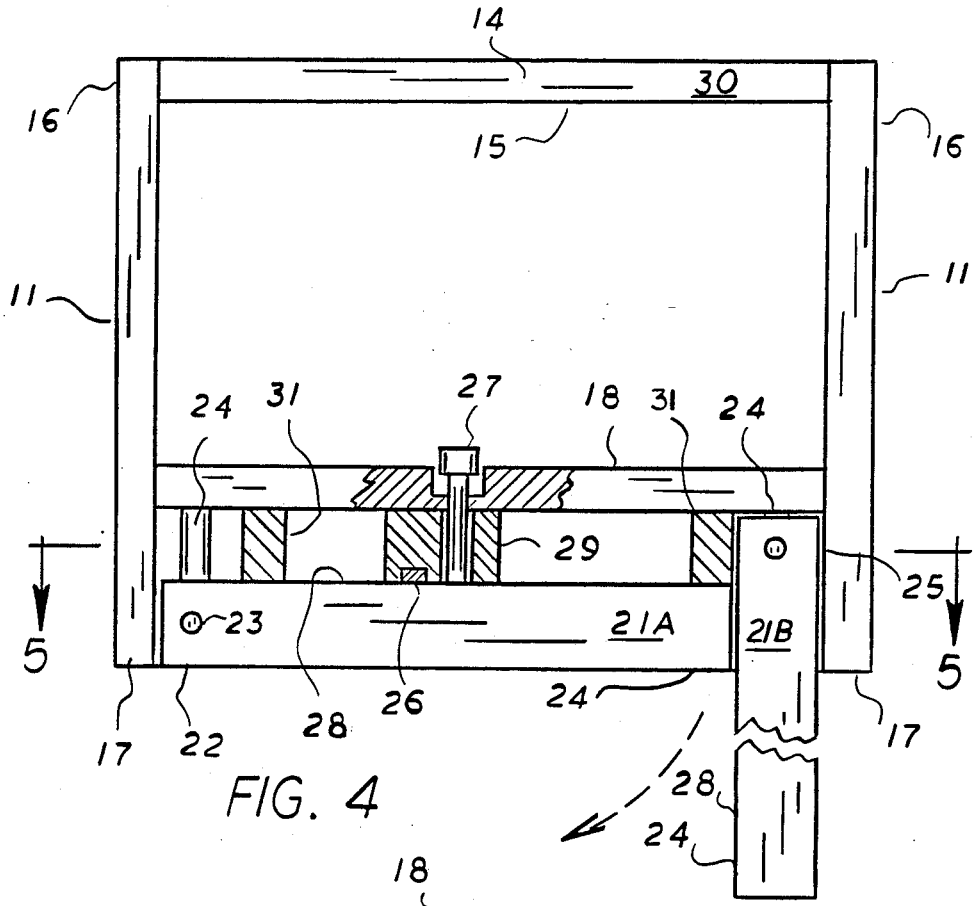
FIG. 4 is a side view partly in section, showing one supplementary leg in a stored mode and another supplementary leg in a deployed mode.
Figure 6:
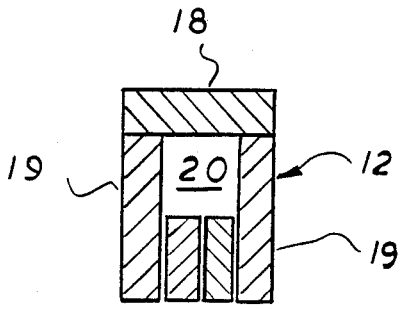
FIG. 6 is a sectional view taken upon the line 6—6 of FIG. 5.

Paired straight supplementary legs are disposed in side by side relationship within cavity 20 of each housing. That leg of each pair which faces the interior of the table is designated 21A, and the other leg of the pair, which faces outwardly, is designated 21B. Each of said supplementary legs have a proximal extremity 22 secured to the end portion of the housing by a transverse pivot dowel 23, and a free distal extremity 24. As best shown in FIG. 4, the distal extremity is adapted to swing downwardly from the bottom opening of the housing, and vertically align with the corresponding main leg 11.

Once leg 21A or 21B has swung about its pivot dowel 23 to a vertical position, it is then locked in place by forcing it upwardly into the housing. In such upward motion, dowel 23 rides within vertical slot 24, and the proximal extremity of leg 21A or B becomes tightly embraced by holding means in form of abutment block 31 and the interior surface 25 of main leg 11. The spacing between block 31 and surface 25 is preferably such as to frictionally grip the supplementary leg.

Retaining means in the form of a bar magnet 26 and release push rod 27 are associated with roof panel 18 of each housing. The magnet 26, held by mounting block 29 is adapted to interact with a metal plate or magnet recessed into the inner edge 28 of each supplementary leg. By virtue of such construction, when the supplementary legs are in their stored state, they will not inadvertently swing downwardly when the table is lifted. When it is desired to deploy the supplementary legs, one pushes downwardly upon push rod 27. This overcomes the magnetic attraction force, and allows the supplementary leg to swing downwardly by gravity force.

The panel and the legs and sidewall may be constructed of wood, plastic, composite materials, or still other materials of adequate strength and rigidity as may generally be used in the furniture industry.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A multi-functional table of adjustable height comprising:

(a) a flat top panel having upper and lower surfaces and adapted to be horizontally disposed, (b) four straight main legs extending vertically downwardly from said top panel in a rectangular locus, said main legs being in fixed engagement with said top panel, and having lower extremities disposed in a horizontal plane, (c) paired straight hollow housings in opposed parallel relationship, each housing extending between the lower extremities of two opposed contiguous main legs, said housings having open bottom portions, and end portions adjacent each main leg, (d) two straight supplementary legs stored within each housing, each supplementary leg having a proximal extremity pivotably secured to the housing adjacent the lower extremity of a main leg, and a distal extremity adapted to swing downwardly into a deployed mode in vertical alignment with an associated main leg, (e) holding means located within the end portions of each housing for securing each supplementary leg in its deployed mode, and (f) retaining means associated with each housing for preventing inadvertent deployment of the supplementary legs.

2. The table of claim 1 wherein a sidewall extends upwardly from said top panel in a manner to secure a pillow placed upon said panel.

3. The table of claim 1 wherein said supplementary legs are deployable by gravity force alone.

4. The table of claim 1 wherein said retaining means employ magnets.

5. The table of claim 1 wherein said holding means comprises an abutment structure accurately spaced apart from the associated main leg to permit the associated supplementary leg to slide upwardly to be frictionally gripped between said abutment structure and main leg.

* * * * *